US005849153A

United States Patent [19]

Ishino et al.

[11] Patent Number: 5,849,153

[45] Date of Patent: Dec. 15, 1998

[54] WATER-DISPERSIBLE SHEET AND CIGARETTE USING THE SAME

[75] Inventors: Yoshiaki Ishino, Fuji; Masato Shishikura, Numazu; Toru Tsujimoto; Susumu Minamisawa, both of Tokyo, all of Japan

[73] Assignees: Mishima Paper Co., Ltd., Shizuoka-ken; Japan Tobaco Inc., Tokyo, both of Japan

[21] Appl. No.: 681,995

[22] Filed: Jul. 30, 1996

[30] Foreign Application Priority Data

Aug. 9, 1995 [JP] Japan ..... 7-222780

[51] Int. Cl.[6] ..... D21H 21/14

[52] U.S. Cl. ..... 162/135; 162/146; 162/158; 162/168.1; 162/175; 162/177; 162/181.1; 162/174

[58] Field of Search ..... 162/135, 136, 162/137, 139, 177, 176, 181.1, 146, 174

[56] References Cited

U.S. PATENT DOCUMENTS

| | | | |
|---|---|---|---|
| 2,775,970 | 1/1957 | Schoenbaum | 162/177 |
| 5,722,433 | 3/1998 | Ishino et al. | 162/139 |

FOREIGN PATENT DOCUMENTS

| | | |
|---|---|---|
| 43-28766 | 12/1943 | Japan . |
| 43-1214 | 1/1968 | Japan . |
| 48-27605 | 8/1973 | Japan . |
| 1-168999 | 7/1989 | Japan . |
| 3-8897 | 1/1991 | Japan . |
| 3-167400 | 7/1991 | Japan . |
| 3-180585 | 8/1991 | Japan . |
| 6-184984 | 7/1994 | Japan . |

*Primary Examiner*—Peter Chin
*Attorney, Agent, or Firm*—Birch, Stewart, Kolasch & Birch, LLP

[57] ABSTRACT

A water-dispersible sheet and a cigarette using the sheet are disclosed. The sheet comprises a water-resolvable base paper made from fibrous raw materials and a water-dispersible coating layer containing water-soluble polymer and an alkaline compound. The sheet is also produced through an impregnation treatment for a water-resolvable base paper with a coating mixture containing water-soluble polymer and an alkaline compound, wherein said water-resolvable base paper is made from a mixture of water-dispersible fibers and fibrous carboxymethyl cellulose acid or fibrous carboxyethyl cellulose acid. The gas-permeability of the water-dispersible sheet is controlled by the water-dispersible coating layer or the impregnation treatment.

9 Claims, No Drawings

WATER-DISPERSIBLE SHEET AND CIGARETTE USING THE SAME

BACKGROUND OF THE INVENTION

1. Field of the Invention

The present invention relates to water-dispersible sheets capable of easily resolving or dissolving in water and having a lower gas-permeability than usual water-dispersible sheets. The present invention further relates to cigarettes using said water-dispersible sheets.

2. Description of the Background Art

As water-soluble paper having high water-dispersibility, there have been proposed, for example, paper produced from a mixture of paper-making fibers and fibrous carboxymethyl cellulose with alkali metal compounds (Japanese Patent Publication No. Sho 43-1214, 43-28766, 48-27605), paper produced by mixing inorganic powder which is insoluble or slightly-soluble in water with paper-making fibers or carboxymethyl cellulose (Japanese Patent Laid-Open No. Hei 3-8897, Hei 3-180585), and paper made from a paper stock containing alkali metal salt or alkaline earth metal salt of carboxymethyl cellulose (Japanese Patent Laid-Open No. Hei 1-168999, Hei 3-167400, Hei 6-184984). Since the property of low gas-permeability is not required in the use of the above prior water-soluble papers, the gas-permeability is not taken into account and those papers have extremely high gas-permeability. Usually, the higher the water-dispersibility of a kind of paper, the higher the gas-permeability of the paper. Consequently, water-dispersible paper having an air-permeability adjusted within the prescribed low level of not more than 500 coresta has not yet been provided.

It is necessary that filter plug wrap (plug paper) or filter joining paper (tipping paper) for filter-tipped cigarettes has properties of relatively low gas-permeability, high opacity, high smoothness, high strength, and so on. The gas-permeability should be a relatively low value within the range of not more than 200 coresta, in order to prevent air from penetrating through the surface of filter plug wrap and filter joining paper, and from excessively diluting smoke in the cigarette. Therefore, the filter plug wrap and the filter joining paper have been produced under the condition of a high beating degree, or by using pulp made from some kinds of woods capable of forming low gas-permeable sheets.

Thus, when the gas-permeability of paper is reduced, the water-dispersibility of the paper deteriorates. Accordingly, there is a problem that filter plug wrap and filter joining paper of cigarette butt thrown away are hardly dispersed by rainwater.

SUMMARY OF THE INVENTION

Accordingly, it is an object of the present invention to provide sheets having high water-dispersibility in order that they can disperse by rainwater in natural environment, when the sheets are used as filter plug wrap (plug paper) or filter joining paper (tipping paper) for filter-tipped cigarettes.

Generally speaking, when the beating degree of wood pulp is reduced or the quantity of filler is increased for the purpose of good water-dispersibility, the gas-permeability of the paper becomes higher. It is another object of the present invention to provide water-dispersible sheets having simultaneously a property of gas-permeability adjusted within the prescribed low level and a property of high water-dispersibility. These properties are usually opposite to each other.

The present invention has been accomplished to obtain water-dispersible sheets having low gas-permeability adjusted within the prescribed low level as well as high water-dispersibility by using water-resolvable base paper capable of easily dispersing in water as the base paper and then by applying a coating mixture containing water-soluble polymer and an alkaline compound to the surface of the water-resolvable base paper or by processing the water-resolvable base paper through the alkaline impregnation treatment with said coating mixture.

According to the first form of the present invention, there is provided a water-dispersible sheet comprising (1) a water-resolvable base paper made from fibrous raw materials containing water-dispersible fibers, and (2) a water-dispersible coating layer, which contains water-soluble polymer and an alkaline compound, formed on the surface of at least one side of said base paper, wherein gas-permeability of said water-dispersible sheet is controlled by said water-dispersible coating layer.

In the above first form of the present invention, the water-dispersible coating layer is formed by applying a coating mixture comprising water-soluble polymer and an alkaline compound to the surface(s) of one side or both sides of the water-resolvable base paper with a roll coater or a blade coater.

According to the second form of the present invention, there is provided a water-dispersible sheet comprising a sheet produced through an impregnation treatment for a water-resolvable base paper with a coating mixture containing water-soluble polymer and an alkaline compound, wherein said water-resolvable base paper is made from a mixture of water-dispersible fibers and fibrous carboxymethyl cellulose acid or fibrous carboxyethyl cellulose acid, and gas-permeability of said water-dispersible sheet is controlled by said water-dispersible coating layer.

The alkaline impregnation treatment is carried out by way of a size press method and so on.

DETAILED DESCRIPTION OF THE INVENTION (Making of Water-resolvable Base Paper)

In the present invention, the water-resolvable base paper in itself has water-resolvability as a base paper for a sheet, and said base paper is made by using water-dispersible fibers. The water-dispersible fibers are fibrous materials having a property of substantially dispersing in water, and are generally used for paper-making. The water-dispersible fibers are selected from, for example, wood pulp fibers such as soft-wood kraft pulp, hard-wood kraft pulp or dissolving pulp, and non-wood plant fibers such as kenaf pulp, flax pulp or linter pulp. The average fiber length of the water-dispersible fibers is from 0.1 to 10 mm, preferably from 0.5 to 3 mm, more preferably from 0.8 to 2 mm.

When the water-dispersible fibers, which have specified fiber dimensions of a l/D value of 0.50 or lower, preferably 0.45 or lower, and a L/D value of 60 or lower, and a specified water retention value of 95% or lower at the time before beating, are used for making a base paper, the water-dispersibility of the base paper becomes especially superior.

The fiber dimensions denote values calculated by the following formulas (1) and (2) on the bases of the fiber length (L), the fiber diameter (D) and the fiber lumen diameter (l) which are measured with an optical microscope.

$$l/D=l\div D \quad (1),$$

$$L/D=L\div D \quad (2)$$

The water retention value is an index of a swelling value of pulp defined in JAPAN TAPPI No. 26, and indicates a ratio of water held in swelling fibers in the whole pulp.

The wood pulp fibers or the non-wood plant fibers, in which the l/D value is 0.50 or lower, preferably 0.45 or lower, the L/D value is 60 or lower and the water retention value is 95% or lower, are hard to be swollen or collapsed in the process of forming a sheet by drainage and drying, and bondings between the fibers one another are weak, so that the fibers are easy to disperse in water.

The fiber dimensions and the water retention value depend on a kind of woods or plants which are used as raw materials for pulp. Therefore, in order to obtain pulp having the prescribed values of l/D, L/D and the water retention, pulp produced from selected kinds of woods or plants may be used. There can be given examples, woods such as quercus (oak), populus (aspen), magnolia, eucalyptus and so forth or non-wood plants such as esparto grass and so forth. The pulp having the prescribed fiber dimensions and the prescribed water retention value as mentioned above can be obtained by selecting from the commercially available pulp or by mixing plural kinds of pulps as required.

The water-dispersible fibers are dispersed in water or subject to beating prior to use. If the beating degree is increased, the bondings between fibers increase and both the water-dispersibility and the gas-permeability of the base paper become lower. Therefore, if the beating degree is too much increased, the water-dispersibility of the sheet becomes insufficient, but in contrast, if the beating degree is too much reduced, the gas-permeability of the sheet becomes higher in excess and the strength of the sheet deteriorates. Since there are differences in the water-dispersibility of the water-resolvable base paper by other additives or other treatments, the proper range of the beating degree is suitably selected in accordance with other additives or other treatments as mentioned later.

In the process of making the water-resolvable base paper, there are following methods (i) to (iv) for further improving the water-resolvability of the base paper. It is preferable to improve the water-resolvability of the base paper by means of the following methods, when the coating mixture is applied to the surface of the water-resolvable base paper with a blade coater or a roll coater.

(i) Water-insoluble or water-slightly-soluble powder is mixed with the raw materials for base paper.

(ii) Salt of fibrous carboxymethyl cellulose or salt of fibrous carboxyethyl cellulose is added to the raw materials for base paper.

(iii) An alkali impregnation treatment is carried out on a paper web formed by drainage and drying to make water-resolvable base paper.

(iv) A paper web is formed from fibrous raw materials comprising water-dispersible fibers and fibrous carboxymethyl cellulose acid or fibrous carboxyethyl cellulose acid, and then the paper web is subject to an alkali impregnation treatment.

The water-resolvability of the base paper is further improved by combining (i) with (ii), (i) with (iii), (ii) with (iii), (i) with (ii) and (iii), or (iv) with (i).

With respect to the Method (i)

When water-insoluble or water-slightly-soluble powder is mixed with the fibrous raw materials in the process of forming the water-resolvable base paper, the fibers are prevented from being in contact with one another and the bondings between the fibers become weak, so that the water-resolvable base paper, which is capable of more easily dispersing in water, can be obtained as compared with the case that such powder is not added. Moreover, the opacity of the base paper can also be improved by the addition of the above powder into the paper stock, therefore, sheets made from this base paper is especially suitable for use as products in which high opacity is required.

The water-insoluble powder, which is mixed with the fibrous raw materials in the paper stock for making the water-resolvable base paper, includes nonmetal inorganic compounds, metals, water-insoluble inorganic salt, thermosetting resin powder and thermoplastic resin powder. The water-slightly-soluble powder includes water-slightly-soluble inorganic salt.

The concrete examples of the water-insoluble powder are as follows and the powder can be used separately or together by selecting at least one from the following powder and sometimes together with the water-slightly-soluble powder mentioned later.

metal oxides such as aluminium oxide, titanium oxide carbides such as silicon carbide, boron carbide nitrides such as tri-silicon tetra-nitride, boron nitride silicate minerals such as mica, feldspar, silica minerals, clay minerals, synthetic zeolite, natural zeolite titanate compounds such as potassium titanate, barium titanate silicate compounds such as magnesium silicate phosphate compounds such as zinc phosphate fine powder of urea resin, fine powder of hollow styrene-acrylic resin The concrete examples of the water-slightly-soluble powder are as follows and the powder can be used separately or together by selecting at least one from the following powder and sometimes together with the above-mentioned water-insoluble powder.

metal hydroxides such as aluminium hydroxide, magnesium hydroxide carbonate compounds such as calcium carbonate, barium carbonate, magnesium carbonate, zinc carbonate sulfate compounds such as barium sulfate, calcium sulfate, strontium sulfate The above mentioned water-insoluble powder or water-slightly-soluble powder is mixed with the fibrous raw materials in the paper stock for making a water-resolvable base paper. It is preferable to adjust the amount of the powder so that the water-resolvable base paper may contain 4 to 40% powder by weight. If the content of the water-insoluble or water-slightly-soluble powder in the base paper is less than 4% by weight, the merit of improving the water-dispersibility or the opacity is insignificant, and so it is meaningless to add the powder. On the other hand, if the content of the water-insoluble or water-slightly-soluble powder in the base paper exceeds 40% by weight, the water-dispersibility and the opacity are remarkably improved, whereas the strength deteriorates terribly and the gas-permeability is greatly enhanced and then it becomes difficult to adjust the gas-permeability within the prescribed range.

Remembering that a part of the powder flows out during the process of forming a wet web by drainage, generally, the powder is mixed with fibrous raw materials by selecting the content ratio of the water-insoluble or water-slightly-soluble powder in the range of from 1 to 200 parts, preferably from 5 to 100 parts, per 100 parts of fibrous raw materials by weight, so that the base paper may contain the above desired amount of the powder.

With respect to the Method (ii)

When salt of fibrous carboxymethyl cellulose or salt of fibrous carboxyethyl cellulose is added into the paper stock for making the water-resolvable base paper, these salts in themselves swell and gel in water, so that the fiber-bondings between said salts one another or between said salts and fibrous raw materials are easily dissociated and the sheet rapidly disperses in water.

The salt of fibrous carboxymethyl cellulose and the salt of fibrous carboxyethyl cellulose include salt of alkali metal such as sodium salt (CMC-Na, CEC-Na), potassium salt (CMC-K, CEC-K), lithium salt (CMC-Li, CEC-Li) and the like or mixed salt of said alkali metal salt and another salt such as ammonium salt, amine salt, calcium salt, magnesium salt, aluminium salt or the like.

The degree of substitution of the salt of fibrous carboxymethyl cellulose or the salt of fibrous carboxyethyl cellulose is from 0.1 to 1.5, preferably from 0.3 to 0.5.

The blend percentage of (the salt of fibrous carboxymethyl cellulose or the salt of fibrous carboxyethyl cellulose) :(the whole fibrous raw materials including water-dispersible fibers) is from 1:99 to 50:50, preferably from 3:97 to 15:85, more preferably from 5:95 to 10:90.

With respect to the Method (iii)

As the water-dispersible fibers become easy to swell by alkali, the sheet produced through alkali impregnation treatment after the process of forming a paper web from water-dispersible fibers can be easy to swell and disperse in water and therefore the water-dispersibility of the sheet is enhanced. Alkaline compounds used in the alkali impregnation treatment include the following compounds and these compounds may be used separately or as mixtures of two or more of them. All of them must be soluble in water.

hydroxides of alkali metals such as sodium hydroxide, potassium hydroxide carbonates and hydrogencarbonates of alkali metals such as sodium carbonate, potassium carbonate, sodium hydrogencarbonate phosphates and hydrogenphosphates of alkali metals such as sodium phosphate, sodium hydrogenphosphate alkali metal salts of organic acids such as sodium acetate hydroxides of alkaline earth metals such as calcium hydroxide amines such as ethanolamine The amount of the above alkali compounds absorbed in a paper web is from 0.05 $g/m^2$ to 20 $g/m^2$, preferably from 0.1 $g/m^2$ to 10 $g/m^2$, more preferably from 0.5 $g/m^2$ to 5 $g/m^2$. The impregnation treatment is desirably carried out by the steps of dipping the paper web, after the process of forming the paper web by drainage and drying, into an aqueous solution of one of the above alkaline compounds or a mixed solution of said aqueous solution and a aqueous organic solvent having compatibility with said aqueous solution, and squeezing an excess of the solution from the paper web with a roll. Concretely, an apparatus such as a size press apparatus is preferably used.

Further, in order to prevent the alkaline compounds from falling off after drying, it is preferable to add water-soluble polymer having compatibility with the solution of the alkaline compounds into the solution.

With respect to the Method (iv)

If the fibrous raw materials comprise water-dispersible fibers and fibrous carboxymethyl cellulose acid or fibrous carboxyethyl cellulose acid, and an alkali impregnation treatment is carried out after the formation of the paper web, the fibrous carboxymethyl cellulose acid or the fibrous carboxyethyl cellulose acid forms the corresponding salt which is soluble and capable of swelling in water, and consequently the fiber-bondings between the salt and the fibrous raw materials become weak and the water-dispersibility of the base paper is improved. Therefore, the base paper has sufficient water-dispersibility.

Fibrous carboxymethyl cellulose acid and fibrous carboxyethyl cellulose acid are free acids as CMC-H and CEC-H, and these acids have no swelling ability, differing from the salt of fibrous carboxymethyl cellulose or the salt of fibrous carboxyethyl cellulose. Therefore the above acids keep the fibrous state even in water and can constitute one of the fibrous raw materials for making paper. In order to control the water-dispersibility, up to 20% (weight) of CMC-H or CEC-H can be replaced by salt such as calcium salt (CMC-Ca, CEC-Ca), zirconium salt (CMC-Zr, CEC-Zr), magnesium salt (CMC-Mg, CEC-Mg), aluminium salt (CMC-Al, CEC-Al), zinc salt (CMC-Zn, CEC-Zn) or the like. Two or more kinds of these salts may also be used together.

The degree of substitution of the fibrous carboxymethyl cellulose acid or the fibrous carboxyethyl cellulose acid is from 0.1 to 1.5, preferably from 0.3 to 0.5.

The beating degree of the fibrous carboxymethyl cellulose acid or the fibrous carboxyethyl cellulose acid is preferably in the range from 300 ml CSF to 750 ml CSF by Canadian standard freeness. If the beating degree is less than 300 ml CSF, the water-dispersibility deteriorates to be unsuitable for use.

The blend percentage of the fibrous carboxymethyl cellulose acid or the fibrous carboxyethyl cellulose acid is from 1% to 50% (weight), preferably from 3% to 20% (weight), more preferably from 5% to 10% (weight) of the whole amount of the fibrous raw materials. The blend percentage of the water-dispersible fibers is from 30 to 99% (weight) of the whole amount of the fibrous raw materials for making base paper. As the fibrous raw materials other than the water-dispersible fibers, the fibrous carboxymethyl cellulose acid or the fibrous carboxyethyl cellulose acid can be used, and further semisynthetic fibers, synthetic fibers or inorganic fibers can be mixed with the above fibers as required, on condition that the blend percentage of the semisynthetic fibers, synthetic fibers or inorganic fibers mixed as required must be up to 20% (weight), and the total weight of the water-dispersible fibers and the fibrous carboxymethyl cellulose acid or the fibrous carboxyethyl cellulose acid must occupy from 80 to 100% (weight) of the whole amount of the fibrous raw materials.

Further, water-insoluble or water-slightly-soluble powder may be mixed with the fibrous raw materials in the range of from 1 to 200 parts per 100 parts of fibrous raw materials by weight.

The alkaline compounds used in the alkali impregnation treatment include the following compounds and these compounds can be used separately or as a mixture of two or more of them. All of them must be water-soluble compounds.

hydroxides of alkali metals such as sodium hydroxide, potassium hydroxide carbonates and hydrogencarbonates of alkali metals such as sodium carbonate, potassium carbonate, sodium hydrogencarbonate phosphates and hydrogenphosphates of alkali metals such as sodium phosphate, sodium hydrogenphosphate hydroxides of alkaline earth metals such as calcium hydroxide amines such as ethanolamine, and ammonia borates such as borax silicates such as sodium silicate An aqueous solution of one of the above alkaline compounds or a mixed solution of said aqueous solution and an aqueous organic solvent having compatibility with said aqueous solution is prepared and added to the paper web formed by drainage and drying. The amount of the alkaline compound added to the paper web should be not less than the neutralization equivalent obtained by converting the fibrous carboxymethyl cellulose acid (CMC-H) or the fibrous carboxyethyl cellulose acid (CEC-H) into salts corresponding to the acids, preferably from once to twice as much as said neutralization equivalent.

The preferable method of the addition of the alkaline compound to the paper web is as follows:

The paper web is dipped into the aqueous solution of the above alkaline compound or the mixed solution of said aqueous solution and an aqueous organic solvent having compatibility, and then an excess of the solution is squeezed from the paper web with a roll. Concretely, the addition process is carried out by using an apparatus such as a size press apparatus.

When the additives such as water-insoluble or water-slightly-soluble powder, or salt of fibrous carboxymethyl cellulose are not added into the paper stock as in the above method (iii), it is preferable to adjust the beating degree in the range from 140 ml CSF to 650 ml CSF by Canadian standard freeness or in the range from 17° SR to 60° SR by Schopper Riegler freeness. When the water-dispersibility is improved by the addition of powder and so forth into the paper stock as in the above methods (i), (ii), the beating degree can be increased, and so it is preferable to adjust the beating degree in the range from 60 ml CSF to 650 ml CSF by Canadian standard freeness or in the range from 17° SR to 72° SR by Schopper-Riegler freeness. Further, if the fibrous raw materials comprise water-dispersible fibers and fibrous carboxymethyl cellulose acid or fibrous carboxyethyl cellulose acid, and an alkali impregnation treatment is carried out after the formation of the paper web as in the above method (iv), it is necessary to produce a sheet having high impregnating ability so that alkali impregnation can be uniform in the direction of the thickness of the sheet. Therefore, it is preferable to adjust the beating degree in the range from 140 ml CSF to 720 ml CSF by Canadian standard freeness or in the range from 14° SR to 60° SR by Schopper-Riegler freeness.

If the sheet according to the present invention is used as filter plug wrap or filter joining paper, the ultimate air-permeability of the sheet may be preferably in the range from 1 to 200 coresta or lower. For that purpose it is desirable to adjust the freeness and the basis weight, in order that the water-resolvable base paper may have the air-permeability of not more than about 40000 coresta. When the air-permeability of the water-resolvable base paper is 40000 coresta or lower, there is no need for specially controlling the basis weight of the water-resolvable base paper in relation to the air-permeability. However, from the standpoint of the use such as filter plug wrap or filter joining paper for filter-tipped cigarettes, the desirable basis weight of the base paper is from 15 $g/m^2$ to 80 $g/m^2$, especially 25 $gmM^2$ to 45 $g/m^2$.

When the water-resolvable base paper is impregnated with a coating mixture by a size-press method, the coating mixture is absorbed in not only the surface area of the base paper but the whole base paper. Therefore, remembering that the alkaline compound is contained in the coating mixture, the water-resolvable base paper formed from water-dispersible fibers and fibrous carboxymethyl cellulose acid or fibrous carboxyethyl cellulose acid is preferably used as in the second form of the present invention. That is to say, as the base paper, can be used the same paper web as that before alkali treatment in the method (iv) prior to the surface coating. The fibrous carboxymethyl cellulose acid or the fibrous carboxyethyl cellulose acid forms the corresponding salt with the alkaline compound which permeates the base paper, and this salt is soluble and capable of swelling in water, consequently the fiber-bondings between the salt and the fibrous raw materials become weak and the water-dispersibility of the base paper is improved. Therefore, the whole base paper has sufficient water-dispersibility. Thus, in the second form of the present invention, the alkali compound contained in the coating mixture behaves in the same way as that of the alkali treatment in the method (iv).

(Surface Coating or Impregnation Treatment with a Coating Mixture)

The water-dispersible sheet according to the present invention is produced by a process of a surface coating, in which a coating mixture comprising water-soluble polymer, an alkaline compound and water is applied with a roll coater or a bladed coater to the surface of the water-resolvable base paper made by the aforementioned methods, or said sheet is produced by a impregnation treatment, in which the water-resolvable base paper is impregnated with said coating mixture by means of a size press method.

The reason for the surface coating or the impregnation treatment with the coating mixture containing water-soluble polymer and an alkaline compound is as follows:

In order that the water-dispersibility of the water-resolvable base paper can be improved, the base paper is made from the pulp fibers, in which fiber-bondings are weak, or the base paper is made from a paper stock containing the additives for improving the water-dispersibility. Therefore, the resultant water-resolvable base paper is porous and has high gas-permeability. Consequently, when a sheet is used as filter plug wrap, filter joining paper or other products required to have air-permeability within the prescribed low level, it is necessary to reduce the air-permeability of the sheet.

The water-soluble polymer applied to the surface of the sheet turns to a film by drying, then the polymer makes the surface tight and reduces the air-permeability of the sheet. The water-soluble polymer is in itself soluble in water. In the case that the coating layer is formed with a roll coater or a blade coater, the alkaline compound contained in the coating mixture facilitates the dissolution of the coating layer and the water-dispersibility of the sheet is improved. The alkaline compound dissolves in water and accelerates the break of fiber-bondings among the water-dispersible fibers in the base paper to result in that the water-dispersibility of the base paper is improved. Further, when the salt of fibrous carboxymethyl cellulose or salt of fibrous carboxyethyl cellulose is contained in the base paper, the alkaline compound accelerates hydrogelation of these salts and the water-dispersibility of the base paper can be enhanced.

In the case that the base paper is impregnated with the coating mixture, the coating mixture permeates into the base paper and the alkaline compound in the coating mixture accelerates the break of fiber-bindings among the water-dispersible fibers in the base paper, and additionally, when the fibrous carboxymethyl cellulose acid or the fibrous carboxyethyl cellulose acid is contained in the base paper, CMC-H or CEC-H as free acid is converted to the corresponding salt by the alkaline compound and gains the ability of hydrogelation to result in that the water-dispersibility of the base paper is remarkably enhanced.

The water-soluble polymer should be a polymer capable of turning to a film by drying to reduce the air-permeability of the sheet and should also have function as a binder holding the alkaline compound on the base paper. Further the water-soluble polymer should have a compatibility with the alkaline compound and should be neither decomposed, transformed, nor changed to be water-insoluble by alkali.

As the water-soluble polymer, the following compounds can be used separately, or two or more of them can be used together.

starch such as potato starch, corn starch starch derivatives such as oxidized starch, carboxymethyl starch, phosphate ester starch, hydroxyalkyl starch cellulose derivatives such as salt of carboxymethyl cellulose, salt of carboxyethyl cellulose, methyl cellulose, ethyl cellulose, hydroxyethyl cellulose, hydroxypropyl cellulose polysaccharides constituting plants such as alginate, mannan synthetic polymers such as alkali-proof poly(vinyl alcohol), poly(vinylpyrolidone), poly(alkilene oxide), polyacrylate, isobutylene-maleic anhydride copolymer plant mucilage such as gum arabic, tragacanth gum microbial mucilage such as dextran, levan protein such as casein, glue, gelatin emulsion of copolymers containing acrylic ester unit, methacrylic ester unit or vinyl acetate unit The alkaline compounds used as a component of the coating mixture include the following compounds and these compounds may be used separately or as a mixture of two or more of them. All of them must be water-soluble compounds.

hydroxides of alkali metals such as sodium hydroxide, potassium hydroxide carbonates and hydrogencarbonates of alkali metals such as sodium carbonate, potassium carbonate, sodium hydrogencarbonate phosphates and hydrogenphosphates of alkali metals such as sodium phosphate, sodium hydrogenphosphate hydroxides of alkaline earth metals such as calcium hydroxide amines such as ethanolamine, and ammonia In the case of forming surface coating layers, the blend ratio of (the water-soluble polymer):(the alkaline compound) in the coating mixture is from 100:1 to 100:10000, preferably from 100:10 to 100:1000.

If the amount of the alkaline compound exceeds the above ratio, the effect of reducing the air-permeability by the film formed from the water-soluble polymer diminishes. In contrast, if the amount of the alkaline compound is less than the above ratio, the effect of improving the water-dispersibility of the water-soluble polymer and the base paper is reduced to result in that the intention of adding the alkaline compound is not attained.

In the case that the base paper is subject to the impregnation treatment with the coating mixture by a size press method, the amount of the alkaline compound added in the coating mixture is from once to twice as much as the neutralization equivalent of the fibrous carboxymethyl cellulose acid or the fibrous carboxyethyl cellulose acid in the base paper in order that these acids can be converted to the corresponding water-soluble salts. The blend ratio of (the water-soluble polymer):(the alkaline compound) in the coating mixture is from 10:100 to 1000:100, preferably from 20:100 to 200:100.

The coating amount in the case of the surface coating is from 0.01 to 10 g/m$^2$, preferably 0.1 to 5.0 g/m$^2$ as the amount of the water-soluble polymer, and the coating amount in the case of the impregnation treatment is from 0.01 to 10 g/m$^2$, preferably 0.2 to 5.0 g/m$^2$ as the amount of the water-soluble polymer.

The air-permeability of the sheet can be further reduced by calendering after the surface coating or the impregnation treatment. Therefore the air-permeability of the sheet after the surface coating or the impregnation treatment is controlled by calendering so that the air-permeability of the product can be adjusted within the prescribed range. When the air-permeability of the sheet after the surface coating or the impregnation treatment is not more than 600 coresta, it is possible to adjust the ultimate air-permeability to be not more than 200 coresta by calendering.

In both cases of the surface coating and the impregnation treatment, the coating mixture may contain the water-insoluble or water-slightly-soluble powder. When the coating layer contains water-insoluble or water-slightly-soluble powder, there is advantage that the opacity, the smoothness and the printability improve.

The water-insoluble or water-slightly-soluble powder is the same powder as that added into the water-resolvable base paper in the method (i) mentioned above, that is, nonmetal inorganic compounds, metals, water-insoluble inorganic salt, thermosetting resin powder, thermoplastic resin powder or the like, or water-slightly-soluble inorganic salt can be employed.

The concrete examples of the water-insoluble powder are as follows and the powder can be used separately or together by selecting at least one from the following powder and can be used together with the water-slightly-soluble powder mentioned later.

metal oxides such as aluminium oxide, titanium oxide carbides such as silicon carbide, boron carbide nitrides such as tri-silicon tetra-nitride, boron nitride silicate minerals such as mica, feldspar, silica minerals, clay minerals, synthetic zeolite, natural zeolite titanate compounds such as potassium titanate, barium titanate silicate compounds such as magnesium silicate phosphate compounds such as zinc phosphate fine powder of urea resin, fine powder of hollow styrene-acrylic resin The concrete examples of the water-slightly-soluble powder are as follows and the powder can be used separately or together by selecting at least one from the following powder and sometimes together with the above-mentioned water-insoluble powder.

metal hydroxides such as aluminium hydroxide, magnesium hydroxide carbonate compounds such as calcium carbonate, barium carbonate, magnesium carbonate, zinc carbonate sulfate compounds such as barium sulfate, calcium sulfate, strontium sulfate In the case of the surface coating, the blend ratio of (the water-soluble polymer):(the water-insoluble or water-slightly-soluble powder) is from 5:100 to 100:100, preferably from 10:100 to 30:100. Even though the above powder is contained in the coating mixture, the coating amount is from 0.01 to 10 g/m$^2$, preferably 0.1 to 5.0 g/m$^2$ as the amount of the water-soluble polymer in the coating layer.

In the case of the impregnation treatment, the blend ratio of (the water-soluble polymer):(the water-insoluble or water-slightly-soluble powder) is from 10:100 to 1000:100, preferably from 30:100 to 300:100. Even though the above powder is contained in the coating mixture, the coating amount is from 0.01 to 10 g/m$^2$, preferably 0.2 to 5.0 g/m$^2$ as the amount of the water-soluble polymer.

After the surface coating or the impregnation treatment, calendering is carried out as required for improvement of the smoothness or the printablity and decrease of the air-permeability.

When the coating layer, which comprises the water-soluble polymer and the alkaline compound, or the coating layer, which comprises the water-soluble polymer, the alkaline compound and the water-insoluble or water-slightly-soluble powder, is formed on the surface of the water-resolvable base paper, either of such coating layers is formed on the surface of one side of the base paper or on the surfaces of both sides of the base paper. When either of such coating layers is formed on the surface of one side of the base paper, no coating layer, the coating layer consisting of the water-soluble polymer, or the coating layer, which comprises the water-soluble polymer and the water-insoluble or water-slightly-soluble powder, is formed on the surface of the other side of the base paper.

The above mentioned water-dispersible sheet according to the present invention is suitable for use as filter plug wrap or filter joining paper for filter-tipped cigarettes.

It is preferable that the sheet has an air-permeability of from 1 to 200 coresta for use as filter plug wrap or filter joining paper. The air-permeability is obtained by measuring the amount of air flow passing through 1 $cm^2$ surface of a sample at a differential pressure of 100 mm $H_2O$ by using a paper permeability meter, but the air-permeability of less than 1 coresta cannot be measured. Herein, $$1 \text{ coresta} = 1 \text{ cm}^3 \text{ min}^{-1} \text{ cm}^{-2} \text{ kPa}^{-1} = 1 \text{ cm}^3 \text{ min}^{-1} \text{ cm}^{-2} (100 \text{ mmH}_2\text{O})^{-1} \times 1/0.98$$

When the air-permeability is less than 1 coresta, the air-resistance is measured by using a Oken-type air-resistance tester. The air-resistance is the indicated value (second/100 ml) of water column manometer when the pressured air flows through 10.75 $cm^2$ surface of a sample.

The relation between the air-permeability measured with a paper permeability meter and the air-resistance measured with an Oken type air-resistance tester is indicated as the following regression equation.

$$(\text{air-permeability}) = -0.418 \times (\text{air-resistance}) + 56.85$$

From the above equation, it is found that the lager the value of the air-resistance, the lower the air-permeability. Further, when the air-permeability is 1 coresta, the air-resistance is 133.6 second/100 ml, and when the air-resistance is more than 133.6 second/100 ml, it is impossible to measure the air-permeability. On the other hand, it is impossible to measure the air-resistance when the air-permeability exceeds 56.85 coresta. Both of the air-permeability and the air-resistance are capable of measurement within the following range.

| | | |
|---|---|---|
| air-permeability | 56.85 to 1 | (coresta) |
| air-resistance | 0 to 133.6 | (second/100 ml) |

For the use as the filter joining paper or the filter plug wrap, the lowest limit of the air-permeability of the sheet may be 1 or lower (the air-resistance of 133.6 second/100 ml or higher), and the sheet having approximately zero air-permeability can be employed, but the measurable range is, for example, the air-resistance of from 0 to 50000 second/100 ml.

In the present invention, the gas-permeability of the water-dispersible sheet is controlled by the water-dispersible coating layer or by the impregnation treatment, so that the sheet can be adjusted to have an air-permeability of not more than 200 coresta measured with a paper permeability meter, or to have an air-resistance within the range of 0 to 50000 second/100 ml measured with an Oken type air-resistance tester.

The filter plug wrap as one of the stuffs for cigarettes is a sheet for enveloping filter materials, mainly cellulose acetate, to form columns. The filter joining paper is a sheet used for joining a cigarette part in which cigarette-paper envelopes tobacco, to a filter plug part in which the filter-plug-wrap envelopes filter materials. These stuffs for cigarettes should have various properties.

The first is a property for controlling air-permeability. The amount of air flowing into filter during smoking can be increased by making paper porous mechanically or with laser, or by using paper having high air-permeability, so that components in cigarette-smoke, such as tar or nicotine, are diluted, and the amount of the components in cigarette-smoke during smoking is reduced. With respect to the relations between the air-permeability or porosity of paper and the amount of the components in smoke, various knowledges have been obtained, and then the amount of the components in smoke is controlled in designs and manufactures of cigarette products. In the prior arts for the water-soluble paper or the water-resolvable paper, it is impossible to control the amount of tar and nicotine because the amount of air flowing through said papers is over the air-permeability obtained by perforating paper, or the air-permeability of the paper itself is too high. Therefore, the prior arts have defects that it becomes impossible to make discrimination among cigarette products. It is possible to control the amount of components in smoke by using the water-dispersible sheet according to the present invention.

The second property is printability required for filter joining paper. The discrimination among cigarette products and the improvement of product image are attempted with printing patterns on the filter joining paper. Paper produced according to the prior arts for the water-soluble paper or the water-resolvable paper is porous and has low smoothness. Therefore, various phenomena occur, that is, ink passes through the paper to the other side during printing and the amount of ink on the surface decreases to result in that the printing merit declines, what is called "strike through", or ink on the printed surface becomes uneven, what is called "mottling", or in the case of printing such as gravure printing, the number of missing-dots left out of printing increases. In contrast, in the present invention, the surface of the base paper is coated with a coating mixture containing water-soluble polymer and water, so that the smoothness of the surface is elevated and the above defects during printing can be removed.

On account of satisfying these functions and utilizing the present invention concerning a sheet having high water-dispersibility, cigarettes with filters, which is accelerated to be decomposed in natural environment, can be provided without losing their commercial values.

When the water-dispersible sheet according to the present invention is used as filter joining paper, the sheet is subject to monochrome printing or two to five colors printing by gravure or flexographic press to be patterned with stripes, logo-marks, a tobacco brand, or a ground design of cork, and then subject to cutting to have the prescribed width as filter joining paper. When the sheet is used as filter plug wrap, the sheet is subject to cutting so as to have the prescribed width as filter plug wrap.

In accordance with the present invention, sheets having high water-dispersibility and controlled air-permeability can be obtained. When filter joining paper or filter plug wrap produced from the sheets of the present invention, they have a property of easily decomposing by rainwater as well as a property of the air-permeability of the similar level to the usual filter plug wrap and filter joining paper used for conventional filter parts of cigarettes. Accordingly, when the filter plug wrap and the filter joining paper produced from the sheets of the present invention are used for cigarettes, the cigarette butt thrown away can be easily decomposed by rainwater and then the present invention contributes to maintenance and beautification of environment.

The following experimental examples illustrates that when the water-resolvable base paper is subject to the surface coating or the impregnation treatment by using a coating mixture comprising water-soluble polymer and an alkaline compound, the water-dispersibility of the sheet is enhanced while the air-permeability of the sheet is controlled.

In the following experimental examples, water-dispersion rate, water-dispersion period, gas-permeability and tensile strength are evaluated by the methods mentioned below.

(Water-dispersion Rate)

Ten test pieces of 2.5 cm×2.5 cm are prepared. Five of them are used as samples for measuring the moisture content, and the other five pieces are used as test pieces for measuring the water-dispersion rate. The bone dry weight of the test piece is calculated from the moisture content by the undermentioned equation (I).

Next, 200 ml of deionized water is poured into a 200 ml beaker, and the above five test pieces for measuring the water-dispersion rate are thrown into the water one after another, while the water is stirred at 600 rpm with stirrer.

After the prescribed period of stirring, the content of the beaker is filtered through a standard sieve of 1.7 mm aperture, and then, after drying for over 5 hours at a temperature of 105° C., the bone dry weight is measured. The stirring period is 5 minutes and the water-dispersion rate is obtained from the undermentioned equation (II). It is evaluated that the larger the value of the water-dispersion rate, the higher the water-dispersibility.

The bone dry weight of the test piece=(the weight of the test piece)×(the bone dry weight of the sample for measuring the moisture content)÷(the air-dried weight of the sample for measuring the moisture content) (I)

The water dispersion rate=(the bone dry weight of the test piece−the bone dry weight of the residue on the sieve)÷(the bone dry weight of the test piece)×100 (II)

(Water-dispersion Period)

Five test pieces of 3 cm×3 cm are prepared. Next, 300 ml of deionized water is poured into a 300 ml beaker, and one of the the above five test pieces is thrown into the water, while the water is stirred at 650 rpm with stirrer. The period from the time that the test piece is thrown into the water to the time that the test piece is torn off to two pieces is measured with a stopwatch, and the average value of the five time measurements is employed as the water-dispersion period. It is evaluated that the shorter the water-dispersion period, the higher the water-dispersibility.

(Gas Permeability)

The amounts of air-flow passing through 1 $cm^2$ surface of a sample for 1 minute at the differential pressure of 100 mm $H_2O$ are measured by using a paper permeability meter provided by FILTRONA Co., Ltd (model PPM100).

(Tensile Strength)

The tensile strength is measured according to JIS P8113.

EXPERIMENTAL EXAMPLE 1

This experimental example illustrates that the air-permeability becomes lower and the water-dispersion rate improves, as the coating amount is increased in the case that the surface of the water-resolvable base paper is coated with the coating mixture comprising water-soluble polymer and an alkaline compound.

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 450 ml CSF by Canadian standard freeness. 80 parts by weight of the hard-wood bleached kraft pulp and 20 parts by weight of the soft-wood bleached kraft pulp were blended, and 95 parts by weight of the resultant blended pulp were mixed with 35 parts by weight of powder of calcium carbonate and 5 parts by weight of powder of titanium dioxide to prepare a paper stock, and a water-resolvable base paper having a basis weight of 35 g/$m^2$ was made from the paper stock by using a Foudrinier paper machine.

Next, the surface of one side of the water-resolvable base paper was coated with a coating mixture, which comprised 85 parts by weight of powder of kaoline, 15 parts by weight of powder of titanium dioxide, 16 parts by weight of starch and 105 parts by weight of water, by using a roll coater to prepare a test paper.

The surface of the other side of the test paper was coated with a coating mixture, which comprised 8 parts by weight of sodium salt of carboxymethyl cellulose, 6 parts by weight of sodium carbonate and 94 parts by weight of water, by using a blade coater to produce a water-dispersible sheet.

As for Samples, which differ in the coating amount on the surface coated with the coating mixture comprising the water-soluble polymer and an alkaline compound, the water-dispersion rate and the air-permeability were measured and the results were shown in Table 1 (on page 60). As can be seen from Table 1, the water-dispersion rate is enhanced and the water-dispersibility improves as the coating amount is increased. It is found that as the coating amount is increased, the air-permeability becomes lower and can be adjusted to be 200 coresta or lower.

EXPERIMENTAL EXAMPLE 2

In this experimental example, the water-dispersibility and the air-permeability were investigated concerning three kinds of sheets made through the impregnation treatment for base paper comprising water-dispersible fibers and fibrous carboxymethyl cellulose acid. One of the sheets was impregnated with a coating mixture comprising an alkaline compound, another was impregnated with a coating mixture comprising water-soluble polymer and an alkaline compound, the other was impregnated with a coating mixture comprising water-soluble polymer, an alkaline compound and water-insoluble or water-slightly-soluble powder.

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 230 ml CSF by Canadian standard freeness. 10 parts by weight of fibrous carboxymethyl cellulose acid is mixed with 72 parts by weight of the hard-wood bleached kraft pulp and 18 parts by weight of the soft-wood bleached kraft pulp to prepare a paper stock, and a base paper having a basis weight of 27 g/$m^2$ was made from the paper stock according to JIS P8209.

Next, three kinds of coating mixtures were prepared. One of the coating mixtures was a 5% (weight) aqueous solution of sodium carbonate, another coating mixture comprised 5 parts by weight of sodium carbonate, 6 parts by weight of starch and 89 parts by weight of water, and the other coating mixture comprised 8 parts by weight of sodium carbonate, 2.4 parts by weight of calcium carbonate, 9.6 parts by weight of titanium dioxide, 4 parts by weight of starch and 76 parts by weight of water. The above base paper was subject to the impregnation treatment with each of the above three coating mixtures respectively, by using a size press apparatus. Then the resultant treated papers were finished by means of a super-calendering to produce water-dispersible sheets as samples. As to each sample, the coated amounts of the coating mixtures, water-dispersion period and air-permeability were measured and the results were shown in Table 2 (on page 60).

As can be seen from Table 2, Sample 8, which was impregnated with the coating mixture comprising water-soluble polymer and an alkaline compound, had an almost equal water-dispersibility to that of Sample 7, which was impregnated with the coating solution of an alkaline compound, and the air-permeability of Sample 8 was lower than that of Sample 7.

Further, Sample 9, which was impregnated with the coating mixture comprising water-soluble polymer, an alkaline compound and water-insoluble powder, had an almost equal water-dispersibility to that of Sample 7, which impregnated with the coating solution of an alkaline compound, and Sample 9 had an extremely lower air-permeability than that of Sample 7.

From these results, it is found that when a water-resolvable base paper comprising water-dispersible fibers and fibrous carboxymethyl cellulose acid is subject to an impregnation treatment with a coating mixture containing water-soluble polymer and an alkaline compound, a sheet having a superior water-dispersibility and a controlled air-permeability can be obtained.

The present invention will hereinafter be explained concretely by the examples, but the present invention is not restricted within these examples. The evaluating methods commonly employed in all examples are mentioned below.

(Water-dispersion Rate)

The water-dispersion rate was measured in the same manner as in the aforementioned Experimental Examples, but stirring periods were 5 minutes and 20 minutes.

The water-dispersion rate was measured in Examples 1 to 6 and 9 to 10. In Examples 7 and 8, since the water-dispersion rates of almost all of the test pieces were approximately 100%, it is difficult to estimate significant difference among the samples, and therefore the water-dispersibility was evaluated by only the water-dispersion period.

(Water-dispersion Period)

The water-dispersion period was measured in the same manner as in the aforementioned Experimental Examples. The water-dispersion period was measured in all Examples.

(Air-permeability)

The air-permeability was measured in the same manner as in the aforementioned Experimental Examples.

(Smoothness)

The smoothness was measured according to JAPAN TAPPI No. 5.

(Tensile Strength)

The tensile strength was measured according to JIS P8113.

(Percentage of Weight Decrease in Continuous Rainfall Test)

Filter parts of cigarettes for investigation were put in the combined cycle weather meter provided by SUGA TESTER Co., ltd, and after water was supplied continuously for 30 hours, the bone dry weight of the filter part was measured.

The percentage of weight decrease was obtained from the following equation.

(percentage of weight decrease) (%)=(the bone dry weight before rainfall−the bone dry weight after rainfall)÷(the bone dry weight before rainfall)×100

EXAMPLE 1

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 450 ml CSF by Canadian standard freeness. A paper stock was prepared by mixing 80 parts by weight of the hard-wood bleached kraft pulp with 20 parts by weight of the soft-wood bleached kraft pulp, and laboratory paper (water-resolvable base paper) having a basis weight of 37 g/m$^2$ was made from the paper stock according to JIS P8209.

Next, 7.5 parts by sodium carboxymethyl cellulose and 1.5 parts by weight of sodium hydroxide were mixed with water to prepare a coating mixture having a solid concentration of 9%. This coating mixture was applied at the rate of 0.5 g/m$^2$ to the surface of one side of the base paper with a blade coater. Then, the coated base paper was finished by means of a super-calendering under a nip pressure of 175 Kg/cm at a calender-roll temperature of 90° C. to produce a calendered sheet.

For the resultant calendered sheet, air-permeability, water-dispersion rate (stirring period: 5 minutes, 20 minutes), water-dispersion period, smoothness and tensile strength were measured. As to the one-side coated sheet (sample No. 1-1) the air-permeability was 128 coresta, the water-dispersion rate (5 minutes, 20 minutes) was 47.5%, 68.6% respectively, the water-dispersion period was 36 seconds. From these results, it is found that a water-dispersible sheet having a low air-permeability and a superior water-dispersibility can be obtained. Further, this sheet had a tensile strength of 2.27 kgf and a smoothness of 112 second/10 ml. Therefore, this sheet had properties suitable for use as filter joining paper or filter plug wrap for cigarettes.

EXAMPLE 2

80 parts by weight of hard-wood bleached kraft pulp, which had a l/D value of 0.420 and a L/D value of 57.6 as fiber dimensions and a water retention value of 77% at the time before beating, and 20 parts by weight of soft-wood bleached kraft pulp, which had a l/D value of 0.722 and a L/D value of 79.6 as fiber dimensions and a water retention value of 103% at the time before beating, were blended. The blended wood pulp was subject to beating to the prescribed beating degrees respectively shown in Table 3 (on page 61). Paper stocks were prepared by mixing powder of calcium carbonate with the blended wood pulp in the blend ratios shown in Table 3, and water-resolvable base papers were made by using a Fourdrinier paper machine.

Next, coating mixtures shown in Table 3 were applied to each surface of one side or both sides of these base papers with a roll coater to form coating layers. Then, the coated base papers were finished by means of a super-calendering under a nip pressure of 175 Kg/cm at a calender-roll temperature of 90° C. to produce calendered sheets.

For the resultant calendered sheets (sample No. 2-1 to No. 2-5), air-permeability, water-dispersion rate (stirring period:

5 minutes, 20 minutes), water-dispersion period, smoothness and tensile strength were measured and the results were shown in Table 3.

With regard to the compositions or the combinations of the water-dispersible layers formed on the surfaces of one side or both sides of the base papers, Sample 2-1 had one-side-coating of a coating layer comprising water-soluble polymer and an alkaline compound, Sample 2-2 had both-side-coating in which a coating layer comprising water-soluble polymer and an alkaline compound is formed on one side and a coating layer consisting of water-soluble polymer is formed on the other side, Sample 2-3 had both-side-coating in which coating layers comprising water-soluble polymer and an alkaline compound were formed on both sides, Samples 2-4 or 2-5 had both-side-coating in which a coating layer comprising water-soluble polymer and an alkaline compound is formed on one side and a coating layer comprising water-soluble polymer and water-insoluble powder is formed on the other side.

As can be seen from Table 3, any sample had an air-permeability of less than 200 coresta and a superior water-dispersibility, and further, both of the tensile strength and the smoothness of any sample were suitable values for use as filter joining paper or filter plug wrap for cigarettes.

EXAMPLE 3

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 450 ml CSF by Canadian standard freeness. A paper stock was prepared by mixing 80 parts by weight of the hard-wood bleached kraft pulp with 20 parts by weight of the soft-wood bleached kraft pulp, and laboratory paper (handsheet) having a basis weight of 37 g/m$^2$ was made from the paper stock according to JIS P8209.

Sodium carbonate was used as the alkaline compound to prepare an aqueous alkaline solution, and sodium carboxymethyl cellulose as a water-soluble polymer having compatibility with said solution was added to said solution.

The blend percentage of (alkaline compound):(sodium carboxymethyl cellulose) was 1:2.25 by weight, and the solid concentration was 0.7% by weight. The above laboratory paper was subject to alkaline impregnation treatment with the above aqueous alkaline solutions by using a size-press apparatus to make water-resolvable base papers impregnated with alkali. The amount of alkaline compound absorbed in the base paper was 0.08 g/m$^2$.

Next, 7.5 parts by sodium carboxymethyl cellulose and 1.5 parts by weight of sodium hydroxide were mixed with water to prepare a coating mixture having a solid concentration of 9%. This coating mixture was applied at the rate of 0.5 g/m$^2$ to the surface of one side of the base paper with a blade coater. Then, the coated base paper was finished by means of a super-calendering under a nip pressure of 175 Kg/cm at a calender-roll temperature of 90° C. to produce a calendered sheet.

For the resultant calendered sheet, air-permeability, water-dispersion rate (stirring period: 5 minutes, 20 minutes), water-dispersion period, smoothness and tensile strength were measured. The resultant calendered sheet (sample No. 3-1) had an air-permeability of 122 coresta, water-dispersion rates (5 minutes, 20 minutes) of 46.5% and 72.6% respectively, a water-dispersion period of 24 seconds. From these results, it is found that a water-dispersible sheet having a low air-permeability and a superior water-dispersibility can be obtained. Further, this sheet had a tensile strength of 2.18 kgf and a smoothness of 119 second/10 ml. Therefore, this sheet had properties suitable for use as filter joining paper or filter plug wrap for cigarettes.

EXAMPLE 4

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 450 ml CSF by Canadian standard freeness. A paper stock was prepared by mixing 80 parts by weight of the hard-wood bleached kraft pulp, 20 parts by weight of the soft-wood bleached kraft pulp and 100 parts by weight of powder of calcium carbonate, and then laboratory paper (handsheet) having a basis weight of 37 g/m$^2$ was made from the paper stock according to JIS P8209.

The water-resolvable base paper was made through an alkaline impregnation treatment in the same manner as in Example 3. Next, 0.5 parts by weight of sodium carboxymethyl cellulose and 1.0 parts by weight of sodium hydroxide were mixed with water to prepare a coating mixture having a solid concentration of 6% by weight. The resultant coating mixture was applied at the rate of 0.5 g/m$^2$ to the surface of one side of the base paper by using a blade coater. Then, the coated base paper was finished by means of a super-calendering under a nip pressure of 175 Kg/cm at a calender-roll temperature of 90° C. to produce a calendered sheet.

For the resultant calendered sheet, air-permeability, water-dispersion rate (stirring period: 5 minutes, 20 minutes), water-dispersion period, smoothness and tensile strength were measured. The resultant calendered sheet (sample No. 4-1) had an air-permeability of 130 coresta, water-dispersion rate (5 minutes, 20 minutes) of 55.8%, 73.6%, and a water-dispersion period of 20 second. From these results, it is found that a water-dispersible sheet having a low air-permeability and a superior water-dispersibility can be obtained. Further, this sheet had a tensile strength of 1.72 kgf and a smoothness of 129 second/10 ml. Therefore, this sheet had properties suitable for use as filter joining paper or filter plug wrap for cigarettes.

EXAMPLE 5

Hard-wood bleached kraft pulp, which had a l/D value of 0.330 and a L/D value of 56.8 as fiber dimensions and a water retention value of 93%, and soft-wood bleached kraft pulp, which had a l/D value of 0.722 and a L/D value of 79.6 as fiber dimensions and a water retention value of 103%, were subject to beating to the beating degree of 430 ml CSF by Canadian standard freeness. The hard-wood bleached kraft pulp and the soft-wood bleached kraft pulp were blended in the ratio of 60%:40% (weight). 95 parts by weight of the resultant blended wood pulp were mixed with 5 parts by weight of sodium salt of fibrous carboxymethyl cellulose (a degree of substitution: 0.43) to prepare a paper stock. Laboratory paper (handsheet) having a basis weight of 29 g/m$^2$ was made from the paper stock according to JIS P8209.

Next, the coating mixture, which comprised 2 parts by weight of sodium salt of carboxymethyl cellulose, 3 parts by weight of sodium carbonate and 57.5 parts by weight of water, was applied at the rate of 1.5 g/m$^2$ to the surface of one side of the base paper by using a blade coater. Then, the coated base paper was finished by means of a super-calendering in the same manner as in Example 4 to produce a calendered sheet (Sample No. 5-1).

Besides, the coating mixture, which comprised 4 parts by weight of sodium carboxymethyl cellulose, 9 parts by weight of sodium carbonate and 90 parts by weight of water, was applied at the rate of 0.5 g/m$^2$ to the surface of one side of the base paper by using a blade coater, and the coating mixture, which comprised 19 parts by weight of starch, 70 parts by weight of kaoline, 30 parts by weight of titanium dioxide and 101 parts by weight of water, was applied at the rate of 4.5 g/m$^2$ to the surface of the other side of the base paper by using a blade coater. Then, the resultant both-side-coated paper was finished by means of a super-calendering in the same manner as in Example 4 to produce a calendered sheet (Sample No. 5-2), which had a coating layer comprising water-soluble polymer and an alkaline compound on one side thereof.

For the resultant calendered sheets, air-permeability, water-dispersion rate (stirring period: 5 minutes, 20 minutes), water-dispersion period, smoothness and tensile strength were measured. As to the one-side-coated sheet ( Sample No. 5-1) or the both-side-coated sheet (Sample No. 5-2) respectively, the air-permeability was 155 coresta or 110 coresta, the water-dispersion rate (stirring period: 5 minutes) was 45.9% or 43.8%, the water-dispersion rate (stirring period: 20 minutes) was 75.6% or 68.2%, the water-dispersion period was 26 seconds or 26 seconds. Consequently, it is found that water-dispersible sheets having a low air-permeability and a superior water-dispersibility can be obtained. Further, the tensile strength was 1.72 kgf or 1.88 kgf and the smoothness was 119 second/10 ml or 214 second/10 ml. Therefore, these sheets had properties suitable for use as filter joining paper or filter plug wrap for cigarettes.

EXAMPLE 6

Hard-wood bleached kraft pulp, which had a l/D value of 0.420 and a L/D value of 57.6 as fiber dimensions and a water retention value of 77% at the time before beating, and soft-wood bleached kraft pulp, which had a l/D value of 0.722 and a L/D value of 79.6 as fiber dimensions and a water retention value of 103% at the time before beating, were blended in the ratio of 80%:20% (weight), and the resultant blended wood pulp was subject to beating to the beating degrees shown in Table 4 (on page 62). 95 parts by weight of the resultant blended wood pulp were mixed with 5 parts by weight of sodium salt of fibrous. carboxymethyl cellulose (a degree of substitution: 0.43) and powders of calcium carbonate and titanium dioxide to prepare paper stocks. The blend ratios of calcium carbonate and titanium dioxide in the paper stocks were shown in Table 4 as Samples No. 6-1 to No. 6-6. Water-resolvable base papers of Samples No. 6-1 to No. 6-6 were made from the paper stocks by using a Fourdrinier paper machine.

Next, the coating mixtures shown in Table 4 were applied to each surface of one side or both sides of the base papers with a roll coater. Then, the coated base papers were finished by means of a super-calendering under a nip pressure of 175 Kg/cm at a calender-roll temperature of 90° C. to produce calendered sheets.

Besides, as Sample No. 6-7, the following sample was produced. That is, hard-wood bleached kraft pulp, which had a l/D value of 0.479 and a L/D value of 36.3 as fiber dimensions and a water retention value of 94.6% at the time before beating, and soft-wood bleached kraft pulp, which had a l/D value of 0.722 and a L/D value of 79.6 as fiber dimensions and a water retention value of 103% at the time before beating, were blended in the ratio of 80%:20% (weight), and the resultant blended wood pulps were subject to beating to the beating degrees of 420 ml CSF by Canadian standard freeness. 95 parts by weight of the resultant blended wood pulp were mixed with 5 parts by weight of sodium salt of fibrous carboxymethyl cellulose (a degree of substitution: 0.43) and 22 parts by weight of powder of calcium carbonate to prepare a paper stock. The water-resolvable base paper was made from the paper stock and coated with the coating mixture shown in Table 4, then also finished by means of a super-calendering to produce a calendered sheet.

For the resultant calendered sheets (sample No. 6-1 to No. 6-7), air-permeability, water-dispersion rate (stirring period: 5 minutes, 20 minutes), water-dispersion period, smoothness and tensile strength were measured and the results were shown in Table 4. As can be seen from Table 4, any sample had a low air-permeability and a superior water-dispersibility, regardless of the compositions or combinations of the water-dispersible coating layers on one side or both sides of the base papers. Further, any sample had sufficient tensile strength, and the smoothness was improved by calendering. Therefore any sample had properties suitable for use as filter joining paper or filter plug wrap for cigarettes.

EXAMPLE 7

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 500 ml CSF by Canadian standard freeness. A paper stock was prepared by mixing 15 parts by weight of fibrous carboxymethyl cellulose acid (a degree of substitution of 0.43) with 51 parts by weight of the hard-wood bleached kraft pulp and 34 parts by weight of the soft-wood bleached kraft pulp, and laboratory paper (handsheet) having a basis weight of 35.5 g/m$^2$ was made from the paper stock according to JIS P8209. Then, an aqueous sodium carbonate solution having a concentration of 5% by weight was applied to the base paper by using a size press apparatus to obtain a water-resolvable base paper impregnated with alkali having a basis weight of 37.5 g/m$^2$.

Next, a coating mixture, which comprised 19 parts by weight of starch, 70 parts by weight of kaoline, 30 parts by weight of titanium dioxide and 101 parts by weight of water, was applied at the rate of 7.0 g/m$^2$ to the surface of one side of the base paper by using a blade coater. To the surface of the other side of the base paper, a coating mixture, which comprised 4 parts by weight of sodium salt of carboxymethyl cellulose, 9 parts by weight of sodium carbonate and 90 parts by weight of water, was applied at the rate of 0.5 g/m$^2$ by using a blade coater. Then, the both-side-coated base paper was finished by means of a super-calendering in the same manner as in Example 4 to produce a calendered sheet (Sample No. 7-1).

For the resultant calendered sheet, air-permeability, water-dispersion period, smoothness and tensile strength were measured. The resultant calendered sheet (sample No. 7-1) had an air-permeability of 193 coresta and a water-dispersion period of 12 second. From these results, it is found that a water-dispersible sheet having a low air-permeability and a superior water-dispersibility can be obtained. Further, this sheet had a tensile strength of 2.58 kgf and a smoothness of 245 second/10 ml. Therefore, this sheet had properties suitable for use as filter joining paper or filter plug wrap for cigarettes.

EXAMPLE 8

Hard-wood bleached kraft pulp, which had a l/D value of 0.420 and a L/D value of 57.6 as fiber dimensions and a water retention value of 77%, and soft-wood bleached kraft pulp, which had a l/D value of 0.722 and a L/D value of 79.6 as fiber dimensions and a water retention value of 103%, were subject to beating to the beating degree of 500 ml CSF by Canadian standard freeness. 60 parts by weight of the hard-wood bleached kraft pulp and 40 parts by weight of the soft-wood bleached kraft pulp were blended. Further fibrous carboxymethyl cellulose acid (a degree of substitution of 0.43) and powder of calcium carbonate were mixed with the blended wood pulp in the ratios shown in Table 5 (on page 63) to prepare paper stocks. Then, laboratory papers (handsheets) having a basis weight of 36 g/m$^2$ were made from the paper stocks according to JIS P8209.

An aqueous sodium carbonate solution having a concentration of 5% by weight was applied to the laboratory papers by using a size press apparatus to obtain water-resolvable base papers impregnated with alkali having a basis weight of 38 g/m$^2$.

Next, a coating mixture, which comprised 19 parts by weight of starch, 70 parts by weight of kaoline, 30 parts by weight of titanium dioxide and 101 parts by weight of water, was applied at the rate of 6.5 g/m$^2$ to the surface of one side of each base paper by using a blade coater. To the surface of the other side of each base paper, a coating mixture shown in Table 5 was applied by using a roll coater. Then, the both-side-coated base papers were finished by means of a super-calendering under a nip pressure of 175 Kg/cm at a calender-roll temperature of 90° C. to produce calendered sheets.

For the resultant calendered sheets (sample No. 8-1 and No. 8-2), air-permeability, water-dispersion period, smoothness and tensile strength were measured and the results were shown in Table 5. As can be seen from Table 5, any sample had an air-permeability of the level suitable for use as filter joining paper or filter plug wrap for cigarette, and because the water-dispersion period was short as about 10 seconds, it is found that the water-dispersible sheets having a low air-permeability and a superior water-dispersibility can be obtained. Further, any sample had a sufficient tensile strength, and the smoothness was improved by calendering. Therefore these sheets had properties suitable for use as filter joining paper or filter plug wrap for cigarettes.

EXAMPLE 9

Hard-wood bleached kraft pulp, which had a l/D value of 0.420 and a L/D value of 57.6 as fiber dimensions and a water retention value of 77% at the time before beating, and soft-wood bleached kraft pulp, which had a l/D value of 0.722 and a L/D value of 79.6 as fiber dimensions and a water retention value of 103% at the time before beating, were mixed with fibrous carboxymethyl cellulose acid (a degree of substitution of 0.43) in the ratios shown in Table 6 (on page 64) to prepare paper stocks. Then, laboratory papers were made from the paper stocks according to JIS P8209.

Next, coating mixtures shown in Table 6 were applied to the laboratory papers by using a size press apparatus. Then, two of the coated base papers were finished by means of a super-calendering under a nip pressure of 175 Kg/cm at a calender-roll temperature of 90° C. to produce calendered sheets.

For the resultant sheets calendered or not calendered (sample No. 9-1 to No. 9-3), air-permeability, water-dispersion rate (stirring period: 5 minutes, 20 minutes), water-dispersion period, smoothness and tensile strength were measured and the results were shown in Table 6. As can be seen from Table 6, it is found that any sample had an air-permeability of the low level suitable for use as filter joining paper or filter plug wrap for cigarette and the water-dispersion period was short, and that the water-dispersible sheets having low air-permeability and superior water-dispersibility can be obtained. Further, any sample had a sufficient tensile strength, and the smoothness was improved by calendering. Therefore these sheets had properties suitable for use as filter joining paper or filter plug wrap for cigarettes.

EXAMPLE 10

Hard-wood bleached kraft pulp, which had a l/D value of 0.420 and a L/D value of 57.6 as fiber dimensions and a water retention value of 77% at the time before beating, and soft-wood bleached kraft pulp, which had a l/D value of 0.722 and a L/D value of 79.6 as fiber dimensions and a water retention value of 103% at the time before beating, were mixed with fibrous carboxymethyl cellulose acid (a degree of substitution of 0.43), powder of calcium carbonate and powder of kaoline in the ratios shown in Table 7 (on page 65) to prepare paper stocks. Then, laboratory papers (handsheets) were made from the paper stocks according to JIS P8209.

Next, coating mixtures shown in Table 7 were applied to the base papers by using a size press apparatus. Then, four of the coated base papers were finished by means of a super-calendering under a nip pressure of 175 Kg/cm at a calender-roll temperature of 90° C. to produce calendered sheets.

For the resultant sheets calendered or not calendered (sample No. 10-1 to No. 10-5), air-permeability, water-dispersion rate (stirring period: 5 minutes, 20 minutes), water-dispersion period, smoothness and tensile strength were measured and the results were shown in Table 7. As can be seen from Table 7, it is found that any sample had an air-permeability of the low level suitable for use as filter joining paper or filter plug wrap for cigarette and the water-dispersion period was short, and that the water-dispersible sheets having a low air-permeability and a superior water-dispersibility can be obtained. Further, any sample had a sufficient tensile strength, and the smoothness was improved by calendering. Therefore these sheets had properties suitable for use as filter joining paper or filter plug wrap for cigarettes.

EXAMPLE 11

(For Cigarettes)

The sheet of sample No. 2-5 in Example 2, the sheet of sample No. 6-3 in Example 6 and the sheet of sample No. 7-1 in Example 7, differing in the water-dispersibility and the air-permeability, were cut into the standard size of width to be filter joining paper.

Besides, to obtain a sample having higher air-permeability, the water-resolvable base paper corresponding to that of sample No. 6-3 in Example 6 was employed without coating layers, and it was subject to super-calendering under a nip pressure of 175 Kg/cm at a calender-roll temperature of 90° C. to produce a calendered sheet. This calendered sheet had an air-permeability of 282 coresta and was cut into the standard size of width to be filter joining paper (sample No. 11-1) in the same way as mentioned above.

Further, the sheet of sample No. 6-1 in Example 6 was cut into the standard size of width to be filter plug warp.

For a comparative example, a sheet formed and calendered by a usual method for paper making were used as filter joining paper and filter plug wrap. That is, hard-wood bleached kraft pulp, which had a l/D value of 0.530 and a L/D value of 55.3 as fiber dimensions and a water retention value of 116%, and soft-wood bleached kraft pulp, which had a l/D value of 0.786 and a L/D value of 77.6 as fiber dimensions and a water retention value of 91.5%, were subject to beating to the beating degree of 80 ml CSF by Canadian standard freeness. The hard-wood bleached kraft pulp and the soft-wood bleached kraft pulp were blended in the ratio of 50%:50% (weight), and 100 parts by weight of the resultant blended wood pulp were mixed with 30 parts by weight of powder of calcium carbonate to prepare a paper stock. Body paper (web paper) for filter joining paper having a basis weight of 37 g/m$^2$ and body paper (web paper) for filter plug wrap having a basis weight of 27 g/m$^2$ were made from the above paper stock by using a Fourdrinier paper machine. Then, these body papers without coating were finished by means of a super-calendering under a nip pressure of 175 Kg/cm at a calender-roll temperature of 90° C. to produce calendered sheets. These calendered sheets were cut into the standard sizes to provide comparative filter joining paper (sample No. 11-2) and comparative filter plug wrap (sample No. 11-3).

The filter plug wraps (sample No. 6-1 and No. 11-3) were used to wrap acetate tow to form a filter tip for a cigarette in the same manner as in the case of usual filter tips for cigarettes. This process for making filter was favorable, and there was no problem occurred on paper qualities.

Further, five kinds of filter-tipped cigarettes were produced by way of experiment by combining the filter tips made as mentioned above and cigarette rods formed of one kind of tobacco wrapped with cigarette paper, by using filter joining papers (samples Nos. 2-5, 6-3, 7-1 and 11-1) shown in Table 8 (on page 66). The process for making these samples were favorable, and there was no problem on paper qualities.

With respect to these filter-tipped cigarettes, the draw resistance in cigarette, the contents of components (tar, nicotine) in smoke and the number of smoking times were measured according to TIJO (Japan Tobacco Association) and the filter-tipped cigarettes underwent the continues rainfall tests by using a combined cycle weather meter. The results were shown in Table 8.

Cigarettes of trial products Nos. B, C, D and E, which were produced by using the water-dispersible sheet as the filter joining paper and the filter plug wrap, exhibit good results of high percentages of weight decrease by the combined cycle weather meters as compared with comparative trial product No. A. In the visual observation, the trial product No. A hardly changed, in contrast, the filter using the water-dispersible sheet began to decompose immediately after it underwent the test, and after 30 hours only a portion of the filter joining paper and a portion of the filter plug wrap remained.

Further, the contents of components in smoke in the cases of trial products Nos. B, C and D changed little as compared with the case of trial product No. A, but the content of the component in smoke in the case of trial product No. E considerably decreased.

It can be concluded that trial products Nos. B, C and D produced by using the water-dispersible sheet in which the air-permeability is controlled are suitable for use as staffs for cigarettes because these trial products had good water-dispersibility and the contents of the components in smoke scarcely changed. However, it can be concluded that the water-dispersible sheet having an air-permeability exceeding 200 coresta as sample No. E is not suitable for use as a staff for cigarettes since the contents of the components in smoke decrease exceedingly.

TABLE 1

| sample No. | amount of water-soluble polymer coated g/m$^2$ | amount of alkaline compound coated g/m$^2$ | water-dispersion rate % | air permeability coresta |
|---|---|---|---|---|
| 1 | 0 | 0 | 14.7 | 203 |
| 2 | 0.5 | 0.4 | 30.5 | 198 |
| 3 | 1.1 | 0.9 | 36.1 | 167 |
| 4 | 1.7 | 1.2 | 43.7 | 133 |
| 5 | 2.1 | 1.5 | 42.9 | 132 |
| 6 | 2.6 | 2.07 | 45.1 | 86 |

TABLE 2

| sample No. | amount of water soluble polymer coated g/m$^2$ | amount of water isoluble or water slightly soluble powder coated g/m$^2$ | amount of alkaline compound coated g/m$^2$ | water dispersion rate % | water dispersion period second | air permeability coresta |
|---|---|---|---|---|---|---|
| 7 | 0 | 0 | 1.5 | 46.4 | 29 | 176 |
| 8 | 1.8 | 0 | 1.5 | 46.1 | 23 | 126 |
| 9 | 1.0 | 3.1 | 2.0 | 46.4 | 15 | 22 |

TABLE 3

| sample No. | 2-1 | 2-2 | 2-3 | 2-4 | 2-5 |
|---|---|---|---|---|---|
| beating degree of wood pulp (ml CSF) | 440 | 440 | 440 | 440 | 370 |
| $CaCO_3$ (parts by weight) | 30 | 30 | 30 | 15 | 10 |
| basis weight of water-resolvable base paper (g/m$^2$) | 37 | 37 | 37 | 37 | 31 |
| coating layer on one side | | | | | |
| coating amount (g/m$^2$) | 0 | 0.5 | 0.5 | 5.0 | 4.5 |
| starch (parts by weight) | 0 | 0 | 0 | 20 | 20 |
| kaoline (parts by weight) | 0 | 0 | 0 | 70 | 100 |
| $TiO_2$ (parts by weight) | 0 | 0 | 0 | 30 | 0 |
| $NaCO_3$ (parts by weight) | 0 | 0 | 0 | 0 | 0 |
| CMC (parts by weight) | 0 | 5 | 5 | 0 | 0 |
| NaOH (parts by weight) | 0 | 0 | 1 | 0 | 0 |
| coating layer on the other side | | | | | |
| coating amount (g/m$^2$) | 0.5 | 0.5 | 0.5 | 1.0 | 0.5 |
| starch (parts by weight) | 0 | 0 | 0 | 0 | 0 |
| kaoline (parts by weight) | 0 | 0 | 0 | 0 | 0 |
| $TiO_2$ (parts by weight) | 0 | 0 | 0 | 0 | 0 |
| $NaCO_3$ (parts by weight) | 0 | 0 | 0 | 9 | 9 |
| CMC (parts by weight) | 5 | 5 | 5 | 4 | 4 |
| NaOH (parts by weight) | 1 | 1 | 1 | 0 | 0 |
| sheet calendered after coating | | | | | |

TABLE 3-continued

| sample No. | 2-1 | 2-2 | 2-3 | 2-4 | 2-5 |
|---|---|---|---|---|---|
| basis weight (g/m$^2$) | 37.5 | 38.0 | 38.0 | 43.0 | 36.0 |
| air-permeability (coresta) | 93 | 86 | 83 | 75 | 75 |
| water-dispersion rate | | | | | |
| (stirring period 5 min.) % | 53.0 | 44.8 | 54.6 | 35.3 | 47.3 |
| (stirring period 20 min.) % | 71.4 | 68.9 | 72.7 | 65.7 | 65.9 |
| water-dispersion period (sec) | 20 | 25 | 19 | 46 | 45 |
| tensile strength (kgf) | 1.62 | 1.85 | 1.89 | 2.60 | 2.43 |
| smoothness sec/10 ml | 135 | 134 | 146 | 151 | 106 |

TABLE 4

| sample No. | 6-1 | 6-2 | 6-3 | 6-4 | 6-5 | 6-6 | 6-7 |
|---|---|---|---|---|---|---|---|
| beating degree of wood pulp (ml CSF) | 440 | 440 | 370 | 450 | 440 | 440 | 420 |
| $CaCO_3$ (parts by weight) | 30 | 30 | 30 | 15 | 30 | 30 | 22 |
| $TiO_2$ (parts by weight) | 5 | 5 | 0 | 0 | 5 | 5 | 0 |
| basis weight of water-resolvable base paper (g/m$^2$) | 38 | 38 | 29 | 40 | 35 | 35 | 41 |
| coating layer on one side | | | | | | | |
| coating amount (g/m$^2$) | 0 | 4.8 | 5.0 | 5.0 | 5.0 | 3.0 | 5.0 |
| starch (parts by weight) | 0 | 16 | 22 | 25 | 20 | 20 | 22.5 |
| kaoline (parts by weight) | 0 | 70 | 85 | 50 | 70 | 70 | 100 |
| $TiO_2$ (parts by weight) | 0 | 30 | 15 | 50 | 30 | 30 | 0 |
| $NaCO_3$ (parts by weight) | 0 | 0 | 0 | 0 | 16 | 16 | 0 |
| coating layer on the other side | | | | | | | |
| coating amount (g/m$^2$) | 0.6 | 0.6 | 0.4 | 0.5 | 0.6 | 3.0 | 0.8 |
| starch (parts by weight) | 0 | 0 | 0 | 0 | 0 | 16 | 0 |
| kaoline (parts by weight) | 0 | 0 | 0 | 0 | 0 | 70 | 0 |
| $TiO_2$ (parts by weight) | 0 | 0 | 0 | 0 | 0 | 30 | 0 |
| $NaCO_3$ (parts by weight) | 9 | 9 | 9 | 0 | 9 | 16 | 9 |
| CMC (parts by weight) | 8 | 8 | 4 | 7.5 | 8 | 0 | 4 |
| NaOH (parts by weight) | 0 | 0 | 0 | 1.5 | 0 | 0 | 0 |
| sheet calendered after coating | | | | | | | |
| basis weight (g/m$^2$) | 38.6 | 43.4 | 34.4 | 45.5 | 40.6 | 41.0 | 46.8 |
| air-permeability (coresta) | 169 | 77 | 109 | 19 | 154 | 142 | 14 |
| water-dispersion rate | | | | | | | |
| (stirring period 5 min.) % | 57.5 | 57.4 | 50.8 | 29.1 | 56.5 | 57.0 | 58.3 |
| (stirring period 20 min.) % | 68.5 | 69.4 | 65.3 | 48.1 | 61.2 | 64.3 | 71.5 |
| water-dispersion period (sec) | 14 | 17 | 24 | 76 | 21 | 22 | 28 |
| tensile strength (kgf) | 1.70 | 2.64 | 2.40 | 4.41 | 2.54 | 2.32 | 2.56 |
| smoothness sec/10 ml | 110 | 119 | 192 | 174 | 137 | 207 | 318 |

TABLE 5

| sample No. | 8-1 | 8-2 |
|---|---|---|
| wood pulp (parts by weight) | 95 | 90 |
| fibrous CMC-H (parts by weight) | 5 | 10 |
| $CaCO_3$ (parts by weight) | 30 | 30 |
| $TiO_2$ (parts by weight) | 5 | 5 |
| basis weight of water-resolvable base paper (g/m$^2$) | 36 | 36 |
| coating layer on one side | | |
| coating amount (g/m$^2$) | 6.5 | 5.5 |
| starch (parts by weight) | 19 | 19 |
| kaoline (parts by weight) | 70 | 70 |
| $TiO_2$ (parts by weight) | 30 | 30 |
| coating layer on the other side | | |

TABLE 5-continued

| sample No. | 8-1 | 8-2 |
|---|---|---|
| coating amount (g/m$^2$) | 0.5 | 0.5 |
| $NaCO_3$ (parts by weight) | 9 | 0 |
| CMC (parts by weight) | 4 | 7.5 |
| NaOH (parts by weight) | 0 | 1.5 |
| sheet calendered after coating | | |
| basis weight (g/m$^2$) | 45.0 | 45.0 |
| air-permeability (coresta) | 112 | 122 |
| water-dispersion rate | | |
| (stirring period 5 min.) % | — | — |
| (stirring period 20 min.) % | — | — |

TABLE 5-continued

| sample No. | 8-1 | 8-2 |
|---|---|---|
| water-dispersion period (sec) | 9 | 10 |
| tensile strength (kgf) | 2.65 | 2.58 |
| smoothness (sec/10 ml) | 248 | 287 |

TABLE 6

| sample No. | 9-1 | 9-2 | 9-3 |
|---|---|---|---|
| hard-wood bleached pulp (parts by weight) | 0 | 72 | 64 |
| soft-wood bleached pulp (parts by weight) | 90 | 18 | 16 |
| beating degree mlCSF | 300 | 230 | 230 |

TABLE 6-continued

| sample No. | 9-1 | 9-2 | 9-3 |
|---|---|---|---|
| fibrous CMC-H (parts by weight) | 10 | 10 | 20 |
| $CaCO_3$ (parts by weight) | 0 | 0 | 0 |
| basis weight of the water-resolvable base paper (g/m$^2$) | 27 | 30 | 30 |
| impregnating amount (g/m$^2$) | 2 | 6 | 6 |
| starch (parts by weight) | 3 | 4 | 4 |
| kaoline (parts by weight) | 0 | 0 | 0 |
| $TiO_2$ (parts by weight) | 0 | 9.6 | 9.6 |
| $CaCO_3$ (parts by weight) | 0 | 2.4 | 2.4 |
| $NaCO_3$ (parts by weight) | 5 | 8 | 8 |
| super-calendering | — | done | done |
| sheet calendered or not-calendered | | | |

TABLE 6-continued

| sample No. | 9-1 | 9-2 | 9-3 |
|---|---|---|---|
| basis weight (g/m$^2$) | 29.0 | 36.0 | 36.0 |
| air-permeability (coresta) | 98 | 22 | 101 |
| water-dispersion rate | | | |
| (stirring period 5 min.) % | 26.4 | 46.4 | 80.9 |
| (stirring period 20 min.) % | 35.0 | 78.0 | 87.6 |
| water-dispersion period (sec) | 36 | 15 | 10 |
| tensile strength (kgf) | 5.41 | 2.63 | 2.61 |
| smoothness (sec/10 ml) | 38 | 233 | 188 |

TABLE 7

| sample No. | 10-1 | 10-2 | 10-3 | 10-4 | 10-5 |
|---|---|---|---|---|---|
| hard-wood bleached pulp (parts by weight) | 0 | 72 | 64 | 72 | 64 |
| soft-wood bleached pulp (parts by weight) | 90 | 18 | 16 | 18 | 16 |
| beating degree mlCSF | 370 | 230 | 230 | 230 | 230 |
| fibrous CMC-H (parts by weight) | 10 | 10 | 20 | 10 | 20 |
| kaoline (parts by weight) | 0 | 100 | 100 | 100 | 100 |
| $CaCO_3$ (parts by weight) | 10 | 0 | 0 | 0 | 0 |
| $TiO_2$ (parts by weight) | 0 | 0 | 0 | 5 | 5 |
| basis weight of the water-resolvable base paper (g/m$^2$) | 27 | 30 | 30 | 30 | 30 |
| impregnating amount (g/m$^2$) | 2 | 7 | 7 | 4.5 | 4.5 |
| starch (parts by weight) | 3 | 3.3 | 3.3 | 3 | 3 |
| kaoline (parts by weight) | 0 | 10 | 10 | 0 | 0 |
| $TiO_2$ (parts by weight) | 0 | 0 | 0 | 7.2 | 7.2 |
| $CaCO_3$ (parts by weight) | 0 | 0 | 0 | 1.8 | 1.8 |
| $NaCO_3$ (parts by weight) | 5 | 8 | 8 | 6 | 6 |

TABLE 7-continued

| sample No. | 10-1 | 10-2 | 10-3 | 10-4 | 10-5 |
|---|---|---|---|---|---|
| super-calendering | — | done | done | done | done |
| sheet calendered or not calendered | | | | | |
| basis weight (g/m$^2$) | 29.0 | 37.0 | 37.0 | 34.5 | 34.5 |
| air-permeability (coresta) | 157 | 11 | 48 | 47 | 66 |
| water-dispersion rate | | | | | |
| (stirring period 5 min.) % | 30.6 | 55.2 | 81.4 | 54.5 | 69.5 |
| (stirring period 20 min.) % | 32.8 | 75.0 | 91.9 | 71.0 | 79.0 |
| water-dispersion period (sec) | 39 | 17 | 9 | 18 | 13 |
| tensile strength (kgf) | 6.12 | 2.23 | 1.87 | 1.92 | 2.10 |
| smoothness (sec/10 ml) | 26 | 309 | 302 | 364 | 273 |

TABLE 8

| | filter joining paper | | filter plug wrap | | draw | components in smoke | | numer | percentage of weight |
|---|---|---|---|---|---|---|---|---|---|
| trial product No. | sample No. | air perme-ability coresta | sample No. | air perme-ability coresta | resistance of product mmH$_2$O | tar mg per 1 product | nictoine mg per 1 product | of smoking times times | decrease after 30 hours % |
| A | 11-2 | 5 | 11-3 | 9 | 138 | 10.8 | 0.94 | 6.2 | 5.1 |
| B | 2-5 | 75 | 6-1 | 169 | 134 | 10.6 | 0.92 | 6.3 | 26.5 |
| C | 6-3 | 109 | 6-1 | 169 | 135 | 10.5 | 0.92 | 6.3 | 28.8 |
| D | 7-1 | 193 | 6-1 | 169 | 130 | 10.2 | 0.90 | 6.6 | 34.2 |
| E | 11-1 | 282 | 6-1 | 169 | 118 | 8.7 | 0.77 | 7.4 | 27.4 |

We claim:

1. A water-dispersible sheet, comprising:

(1) a water-resolvable base paper made from fibrous raw materials containing water-dispersible fibers selected from wood pulp fibers and non-wood plant fibers, wherein said water dispersible fibers have fiber dimensions of a l/D value of 0.50 or lower and a L/D value of 60 or lower and a water retention value of 95% or lower at a time before heating, and (2) a water-dispersible coating layer formed on the surface of at least one side of said base paper, which comprises:

water-soluble polymer which is a polymer that turns to a film by drying to reduce the air-permeability of the sheet, which is selected from the group consisting of starch, starch derivatives, cellulose derivatives, polysaccharides, synthetic polymers, plant mucilage, microbial mucilage and protein, and an alkaline compound which is selected from the group consisting of hydroxides of alkali metals, carbonates and hydrogen carbonates of alkali metals, phosphates and hydrogenphosphates of alkali metals, hydroxides of alkaline earth metals and amines, wherein a blend ratio of the water soluble polymer to the alkaline compound in a coating mixture is from 100:1 to 100:10,000 and wherein a coating amount of the water-soluble polymer is from 0.01 to 10 gm2.

2. The water-dispersible sheet according to claim 1, wherein said water-resolvable base paper is made from fibrous raw materials mixed with water-insoluble powder selected from the group consisting of nonmetal inorganic compounds, metals, water-insoluble inorganic salt, thermo-setting resin powder and thermoplastic resin powder or water-slightly-soluble powder which is an inorganic salt.

3. The water-dispersible sheet according to claim 1 or 2, wherein said water-resolvable base paper is made from fibrous raw materials mixed with salt of fibrous carboxymethyl cellulose or salt of fibrous carboxyethyl cellulose, wherein a blend percentage of the salt of fibrous carboxymethyl cellulose or salt of fibrous carboxyethyl cellulose to the whole fibrous raw materials including water-dispersible fibers is from 1:99 to 50:50.

4. The water-dispersible sheet as claimed in claim 1, wherein said water-resolvable base paper is made through an alkali impregnation treatment.

5. The water-dispersible sheet according to claim 1, wherein said water-resolvable base paper is made through an alkali impregnation treatment for a paper web made from fibrous raw materials containing water dispersible fibers and fibrous carboxymethyl cellulose acid or fibrous carboxyethyl cellulose acid, wherein the blend percentage of the fibrous carboxymethyl cellulose acid or fibrous carboxyethyl cellulose acid is from 1% to 50% weight of the whole amount of the fibrous raw materials, and the blend percentage of the water-dispersible fibers is from 30 to 99% weight of the whole amount of the fibrous raw materials for making base paper.

6. The water-dispersible sheet according to claim 1, wherein the water-dispersible coating layer comprises water-soluble polymer, an alkaline compound and water-insoluble powder selected from the group consisting of nonmetal inorganic compounds, metals, water-insoluble inorganic salt, thermosetting resin powder and thermoplastic resin powder or water-slightly-soluble powder which is an inorganic salt.

7. A water-dispersible sheet, comprising:

a sheet produced through an impregnation treatment for a water-resolvable base paper with a coating mixture comprising:

a water-soluble polymer which is a polymer that turns to a film by drying to reduce the air-permeability of the sheet selected from the group consisting of starch, starch derivatives, cellulose derivatives, polysaccharides, synthetic polymers, plant mucilage, microbial mucilage and protein, and an alkaline compound selected from the group consisting of hydroxides of alkali metals, carbonates and hydrogen carbonates of alkali metals, phosphates and hydrogenphosphates of alkali metals, hydroxides of alkaline earth metals and amines, wherein said water-resolvable base paper is made from a mixture of water-dispersible fibers and fibrous carboxymethyl cellulose acid or fibrous carboxyethyl cellulose acid, wherein the blend percentage of the fibrous carboxymethyl cellulose acid or fibrous carboxyethyl cellulose acid is from 1% to 50% weight of the whole amount of the fibrous raw materials, and the blend percentage of the water-dispersible fibers is from 30 to 99% weight of the whole amount of the fibrous raw materials for making base paper, and wherein a blend ratio of the water-soluble polymer to the alkaline compound is from 10:100 to 1000:100, and wherein a coating amount of the water soluble polymer is from 0.01 to 10 $g/m^2$.

8. The water-dispersible sheet according to claim 7, wherein said water-resolvable base paper is made from a mixture of the water-dispersible fibers, fibrous carboxymethyl cellulose acid or fibrous carboxyethyl cellulose acid and water-insoluble powder selected from the group consisting of nonmetal inorganic compounds, metals, water-insoluble inorganic salt, thermosetting resin powder and thermoplastic resin powder or water-slightly-soluble powder which is an inorganic salt.

9. The water-dispersible sheet according to claim 1 or 7, wherein said sheet is adjusted to have an air-permeability of not more than 200 coresta measured with a paper permeability meter, or to have an air-resistance within the range of 0 to 50000 second/100 ml measured with an Oken type air-resistance tester.

* * * * *